United States Patent [19]

Endo et al.

[11] Patent Number: 4,735,581

[45] Date of Patent: Apr. 5, 1988

[54] PACKING PLUG ASSEMBLY IN CONNECTOR AND WATERPROOF CONNECTOR USING SAME

[75] Inventors: Takayoshi Endo; Tamio Watanabe; Satoshi Yamada; Isao Kameyama; Tetsuo Kato, all of Gotenba, Japan

[73] Assignee: Yazaki Corporation, Tokyo, Japan

[21] Appl. No.: 890,612

[22] Filed: Jul. 30, 1986

[30] Foreign Application Priority Data

Mar. 12, 1986 [JP] Japan ..... 61-34576[U]

[51] Int. Cl.[4] ..... H01R 13/52

[52] U.S. Cl. ..... 439/278; 439/587

[58] Field of Search ..... 339/59-61

[56] References Cited

U.S. PATENT DOCUMENTS

| | | | |
|---|---|---|---|
| 2,642,474 | 6/1953 | Bowar | 339/60 |
| 4,583,805 | 4/1986 | Mantlik | 339/59 R |
| 4,621,883 | 11/1986 | Noguchi | 439/278 |
| 4,639,061 | 1/1987 | Muzslay | 439/587 |

FOREIGN PATENT DOCUMENTS

| | | |
|---|---|---|
| 0073083 | 3/1983 | European Pat. Off. . |
| 311032 | 5/1929 | United Kingdom . |
| 877888 | 9/1961 | United Kingdom . |
| 940833 | 11/1963 | United Kingdom . |
| 1378817 | 12/1974 | United Kingdom . |
| 1407336 | 9/1975 | United Kingdom . |
| 1594321 | 7/1981 | United Kingdom . |

*Primary Examiner*—Gil Weidenfeld
*Assistant Examiner*—Paula A. Austin

[57] ABSTRACT

A packing plug assembly to be used in a connector housing to provide a seal therewithin. The assembly is composed of a resilient plug body and one or more rigid members. The resilient plug body is formed with a through hole therein to receive an insulated wire therein whereas the remaining portion of the resilient plug body is penetrated by the reinforcing members. The leading end of the wire is attached with a terminal which is securely pressed into the connector by means of rigid reinforcing member penetrating the resilient plug body to assure latching engagement therein when the plug assembly is press fitted into the connector. Such press fitting may be done by use of a rear holder adapted to be pushed into the connector after the resilient plug body.

4 Claims, 3 Drawing Sheets

PACKING PLUG ASSEMBLY IN CONNECTOR AND WATERPROOF CONNECTOR USING SAME

BACKGROUND OF THE INVENTION

The present invention relates to a packing plug assembly used in a waterproof connector, especially a packing plug assembly having a structure for preventing insufficient retention of a terminal therein, as well as an electrical connector made employable in an environment exposed to water by using said packing plug assembly.

As the prior art there is known, for example, such a waterproof connector as shown in FIG. 7, in which terminals B and B' inserted in connector housings A and A' are retained by flexible latch arms A and $A_1'$, and rubber packing plugs C and C' are fitted in rear portions of the connector housings A and A'; further, the packing plugs are retained by rear holders D and D' and stabilizers $B_1$ and $B_1'$ at the rear ends of the electrical terminals B and $B_1'$ are brought into engagement with the packing plugs C and C' to doubly retain the electrical terminals B and B'.

In such structure, however, even when the electrical terminals B and B' are inserted to an incomplete extent, the packing plugs C and C' can be fitted in the connector housings incompletely due to the elasticity of the packing plugs C and C', resulting in that the packing plugs are not retained by the flexible latch arms $A_1$ and $A_1'$ serving as main retainers, not to mention double retention.

In order to overcome the above drawback, the applicant in the present case has proposed a rubber packing plug in a connection (Japanese Laid Open No. 133587/85) in which with respect to a retaining frame comprising a pressing portion and a base portion interconnected through a connecting rod there is integrally formed a rubber plug so as to have an outer peripheral portion larger in diameter than the pressing portion and the base portion while leaving a pressing surface of the pressing portion, and in the pressing portion and the base portion there is formed an electric wire insertion hole for the rubber plug.

In this case, however, there have been the following problems. Since the rubber plug is molded integrally with the retaining frame, the manufacturing cost is apt to become high. Besides, since the connecting rod is not always mounted in parallel with the outer peripheral portion of the rubber plug, elastic deformations of the outer peripheral portion do not become constant and there arises a scatter of sealability.

In order to obtain an electric connector of a high waterseal it is necessary to use a housing of a watertight structure and it is also necessary that the gap between the housing and an electric wire with a terminal inserted and fixed in the housing be of a watertight structure. To this end, usually a packing plug which permits an electric wire to pass therethrough is fitted in a rear opening portion of the housing.

The packing plug is formed of a soft and elastic material, e.g. rubber, to enhance the watertightness. But, because of recovery from the deformation produced when pushing the plug into the rear opening portion of the housing and the resulting return, there easily occur troubles such as incomplete insertion and dislocation of the terminal. According to one method for preventing the occurrence of such troubles, a rear holder serving as means for preventing dislocation of the waterproof plug is provided at a rear end portion of the housing. Even by this method, however, the difficulty of insertion of the waterproof plug is still not improved.

SUMMARY OF THE INVENTION

It is an object of the present invention to provide a packing plug assembly in a connector capable of solving the above-mentioned problems and being produced inexpensively while obtaining uniform seal.

It is another object of the present invention to realize more economically a waterproof connector which permits easy insertion and assures retention of a terminal within the connector.

In order to achieve the above-mentioned objects of the present invention there is provided a packing plug assembly for use in a connector housing to provide a seal therewithin comprising a resilient plug body having first and second ends, said resilient plug body having main hole means formed therein to open at said first and second ends to accept an insulated electric wire therethrough and auxiliary hole means formed therein to open at said first end; and rigid reinforcing means inserted into said auxiliary hole means from the first end to provide a rigidity at said first and second ends of said resilient plug.

Further, there is also provided in another aspect of the present invention, a waterproof connector comprising a connector housing adapted to receive mating terminals therein for connection with each other and having latch means for retaining said terminals therein; a resilient plug body having first and second ends, said resilient plug body having main hole means formed therein to open at said first and second ends to accept an insulated wire therethrough and auxiliary hole means formed therein to open at said first end, said electric wire being crimped by said terminals at a leading end of said electric wire; rigid reinforcing means inserted into said auxiliary hole means from the first end to provide a rigidity at said first and second ends of said resilient plug; and means for rigid enforcing means to press in turn said terminal into engagement with said latch means.

DESCRIPTION OF THE PREFERRED EMBODIMENTS

Embodiments of the present invention will be described in detail hereinunder with reference to the drawings.

Figure 1:
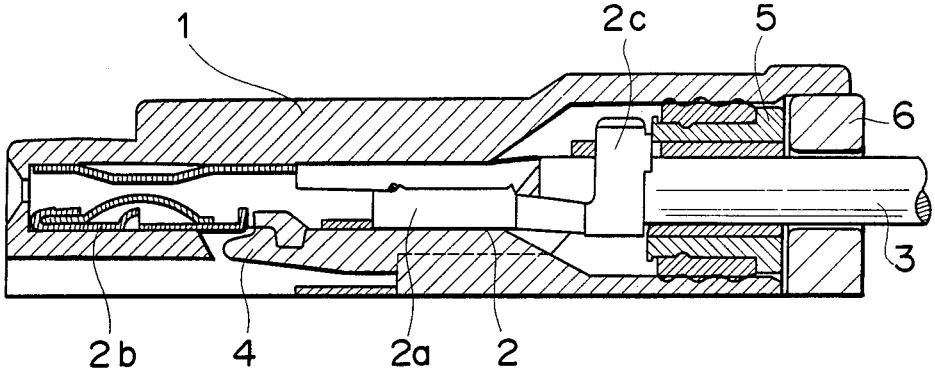
FIG. 1 is a sectional view showing a structure of a waterproof connector in the present invention.
Figure 2A:
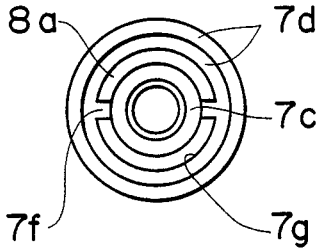
FIGS. 2*a* to 2*c* are a front view, a side view and a longitudinal sectional view, respectively, of a packing plug assembly according to an embodiment of the present invention.
Figure 2B:
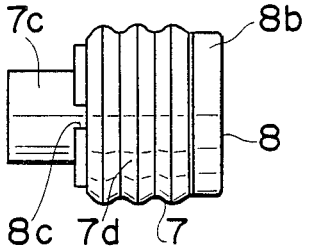
Figure 2C:
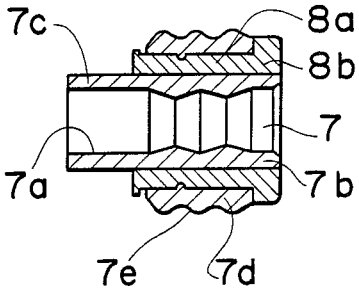

In FIGS. 1 and 2, the reference numeral 1 denotes a connector housing; numeral 2 denotes a terminal member; and numeral 3 denotes an insulated electric wire, to which is attached an electric wire connecting portion 2*a* of the terminal member 2 at a rear thereof by crimping. An electric contact portion 2*b* of the electric connector member 2 is retained primarily by means of a lance 4, whereas packing plug assembly 5 attached to a rear end of the electric wire connecting portion 2*a* is prevented the terminal from coming off backward by means of a rear holder 6. Thus, the terminal member 2 is doubly retained in the connector.

The packing plug assembly 5 is constituted by two components—a rubber plug body 7 which is a resilient member and a reinforcing sleeve 8 which is a rigid synthetic resin insulator—. The rubber plug body 7 is of a double structure comprising an inner cylindrical portion 7*b* which is formed with an electric wire insertion through hole extending longitudinally therewithin, said inner cylindrical portion 7*b* having a crimping portion 7*b* for the electric connector member 2, the crimping 7*c* portion extending at its forward side of the cylindrical portion 7*b;* and an outer cylindrical portion 7*d* formed over the outer periphery of the cylindrical portion 7*b* at the rearward side of the latter. Said outer cylindrical portion 7*d* is formed with an annular corrugated uneven surface 7*e* for enhancing the sealing effect, and an approximately semicircular opening 7*g* is formed in a fore end portion of the outer cylindrical portion 7*d* while leaving a connection 7*f* with the cylindrical portion 7*b*. The reinforcing sleeve 8 comprises a body 8*a*, a flange-like pressing portion 8*b* formed circumferentially at a base end portion of the body 8*a*, and a notched portion 8*c* corresponding to the connection 7*f*, the notched portion 8*c* being provided at a fore end portion of the body 8*a*.

For putting the packing plug assembly 5 and the terminal 2 together, the electric wire 3 is first inserted into the electric wire insertion hole 7*a* in the rubber plug body 7 and then the body 8*a* of the reinforcing sleeve 8 is press-fitted between the cylindrical portion 7*b* and the outer cylindrical portion 7*d* of the rubber plug, allowing the fore end of the body 8*a* to project from the opening 7*g* (the reinforcing sleeve may be fitted in the rubber plug in advance). Therafter, while a forward end face of the body 8*a* of the reinforcing sleeve 8 is in contact with a stabilizer 2*c* of the electric connector member 2, the electric wire connecting portion 2*a* and the stabilizer 2*c* are crimped whereby the crimping portion 7*c* of the rubber plug body 7 and the electric wire 3 are pressure-fixed together.

In this state, by inserting the terminal 2 into the housing 1 and fitting the rear holder 6 into the housing from behind the holder 6 is brought into engagement with the pressing portion 8*b* of the reinforcing sleeve 8 in the packing plug assembly 5, thereby pushing the pressing portion forward, so that the terminal 2 is sure to advance whereby the foregoing double retaining is attained.

In this double retention, the cylindrical portion 7*b* and the outer cylindrical portion 7*d* of the rubber plug body 7 are supported by the reinforcing sleeve 8 inserted therebetween and are given a sufficient reaction force, whereby the seal between the rubber plug 7 and the housing and that between the rubber plug 7 and the electric wire 3 are enhanced, affording a uniformly sealed condition.

Figure 3A:
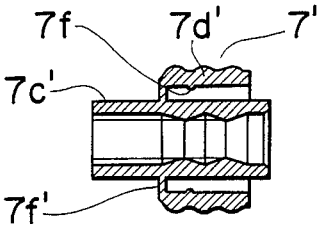
FIGS. 3*a* to 3*c* are a sectional view of a rubber plug as a packing plug assembly according to another embodiment of the present invention, a sectional view of a reinforcing sleeve and a side view of a combined state, respectively.
Figure 3B:
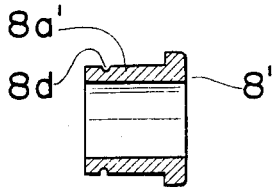
Figure 3C:
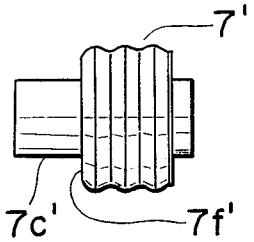
Figure 7:
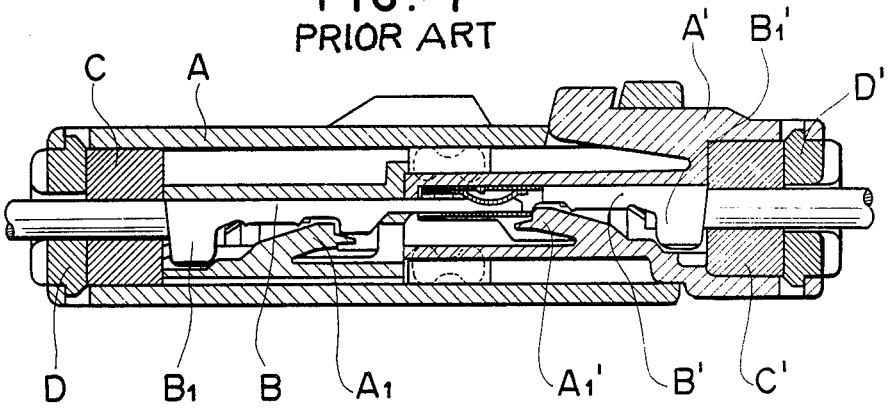
FIG. 7 PRIOR ART
FIG. 7 is a longitudinal sectional view of a conventional connector.

FIGS. 3*a* to 3*c* illustrate another embodiment of a packing plug assembly accoridng to the present invention, in which a fore end part of an outer cylindrical portion 7*d'* in a rubber plug 7' is provided in the form of a thin blind wall 7*f'* not having the foregoing opening 7*g*, and an annular projection 7*c'* is formed inside the outer cylindrical portion 7*d'*, while an annular recess 8*d* is formed in the outer periphery of a body 8*a'* of a reinforcing sleeve 8'.

In this case, the reinforcing sleeve 8' is press-fitted between the cylindrical portion 7*c'* and the outer cylindrical portion 7*d'* of the rubber plug 7' and this is the same as in the previous embodiment, but both portions are fitted and fixed together by means of the annular projection 7*f* and the annular recess 8*d*. Further, the thin blind wall 7*f'* is provided with rigidity by means of the fore end of the rigid body 8*a'* to firmly push the foregoing stablizer 2*c* of the terminal 2 through the blind wall 7*f'*.

Although in the above embodiments the reinforcing sleeve is fitted between the inner cylindrical portion and the outer cylindrical portion of the rubber plug body, the rubber plug portion may be molded integrally with the reinforcing sleeve.

In each of the above embodiments the packing plug assembly is constituted by the two components of a rubber plug body and a reinforcing sleeve, and these components may be formed separately and combined together before use, thus resulting in that the manufacturing cost is reduced. Moreover, the reinforcing sleeve serves as a supporting wall for the inner cylindrical portion and the outer cylindrical portion of the rubber plug, thus ensuring a uniform seal.

Figure 4:
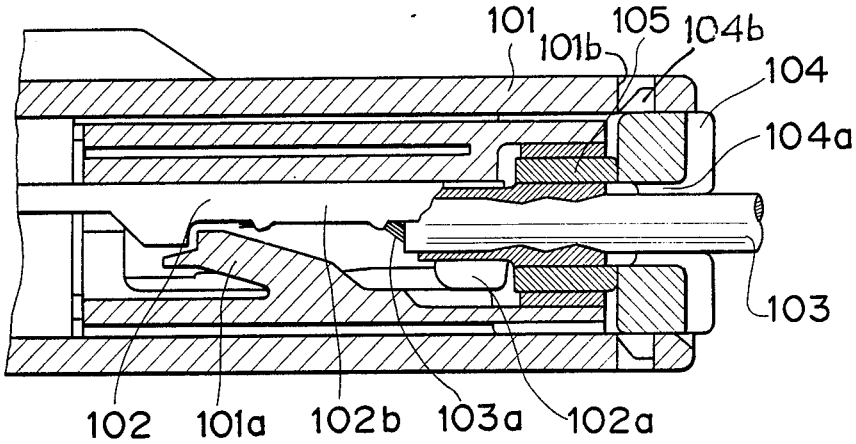
FIG. 4 is a sectional view showing another structure of a waterproof connector.

FIG. 4 is a sectional view showing another example of a waterproof connector and parts connected thereby, in which the reference numerals 101, 102 and 103 denote a connector housing, a terminal and an insulated electric wire 103, respectively, the electric wire 103 being crimped and fixed by means of an electric wire crimping portion 102*a* provided at a rear part of the terminal 102. In the portion adjacent to the terminal 102 of the electric wire 103 there is provided a packing plug assembly 105 with the electric wire 103 extending therethrough, the packing plug assembly 105 being fitted in a rear end opening of the housing 101. Further, behind the packing plug assembly 105 is disposed a rear holder 104 having a through hole 104*a* which permits the electric wire 103 to pass therethrough. The rear holder 104 is held in place by engagement of an engaging pawl 104*b* thereof with an engaging hole 101*b* formed near a rear end of the housing 101.

Figures 5A, 5B, 5C:
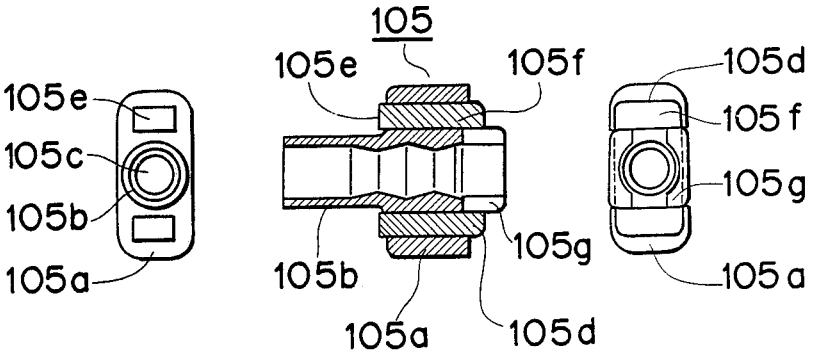
FIGS. 5*a* to 5*c* are a front view, a longitudinal sectional view and a rear view of a packing plug assembly used therein according to a further embodiment of the invention.

As shown in FIGS. 5*a* to 5*c*, the packing plug assembly 105, which is formed from a soft elastic material such as rubber, is constituted by the comination of a plug portion 105*a* formed from a rigid synthetic resin and a reinforcing member 105*d* extending through the plug portion 105*a* from the rear to the fore end of the plug portion, the plug portion 105*a* having a through hole 105*c* formed centrally therein for passing therethrough of the electric wire 103, with a cylindrical portion 105*b* projecting from a fore end part of the plug portion 105*a*, the cylindrical portion 105*b* being capable of coming into close contact with an outer surface of the insulation covering of the electric wire 103. The reinforcing member 105*d* comprises a rod-like portion 105*e*, a pressing portion 105*f* forming a rear end of the rod-like portion, and a projection 105*g* which further projects rearward to effect positioning relative to the through hole 104*a* of the rear holder 104.

In assembling the waterproof connector using the packing plug assembly 105, first the eletric wire 103 is inserted through the packing plug assembly 105, allowing the cylindrical portion 105*b* to come into close contact with an outer surface of the insulation covering of the electric wire 103, then the electric wire 103 and the cylindrical portion 105*b* are fixed together from the outside by the crimping portion 102*a* of the terminal 102. Further, a core 103*a* is fixed by means of a conductor crimping portion 102*b*. The terminal 102 after assembly is inserted from the rear end opening of the housing 101, then the waterproof plug 105 is fitted and pushed in by the rear holder 104. The positioning projection 105*g* at the rear end of the plug body is fitted in the through hole 104*a* of the rear holder 104, such that the reinforcing member 105*d* is pushed in the forward direction through the pressing portion 105*f*. This pressing force is immeidately transmitted to the electric wire crimping portion 102*a* which constitutes a stabilizer for the terminal 102. Consequently, the engaging pawl 104*b* of the rear holder 104 comes into engagement with the engaging hole 101*b* of the housing 101 and at the same time the terminal 102 is retained by a latch arm or a lance 101*a*, whereby a double retention is attained. Moreover, in the waterproof connector thus assembled, the packing plug assembly 105 is sure to be fitted tightly in the housing 101 and a close contact is also attained between the electric wire 103 and the packing plug assembly 105, thus performing a perfect sealing function.

Figure 6:
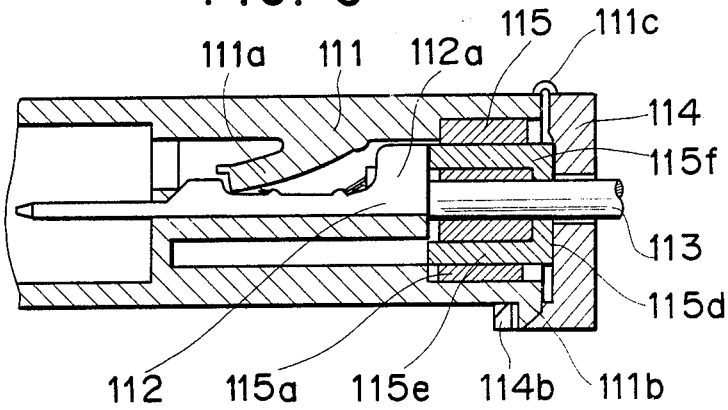
FIG. 6 is a sectional view showing still another structure of a packing plug assembly.

FIG. 6 shows an example of a waterproof connector using another shape of a packing plug assembly. A terminal 112 with an electric wire 113 fixed thereto by crimping is inserted into a housing 111 and retained by a latch arm or a lance 111*a*, and a rear holder 114 is provided at a rear end part of the housing 111 through a hinge 111*e*. An engaging portion 114*b*, formed at the other end of the rear holder 114 is capable of engaging an engaging pawl 111*b* formed at the rear end of the housing 111.

A packing plug assembly 115 is composed of a plug body 115*a* having a through hole with the electric wire 113 passing therethrough, and a reinforcing member 115*d* having a pressing portion 115*f* formed at the rear end of the plug portion and a rod-like portion 115*e* adjacent to the pressing portion 115*f* and extending through the plug portion up to the fore end of the plug portion. More specifically, the fore end of the rod-like portion 115*e* is slightly projecting from the fore end of the plug portion 115*a*. Like the preceding embodiments, the plug portion 115*a* is formed of a soft elastic material such as rubber whereas the reinforcing member 115*d* is formed of a rigid synthetic resin. Also in assembling the connector using the waterproof plug 115 there is attained the same function as in the preceding embodiments.

Since the packing plug assembly is of such a special structure as set forth above, the terminal can be inserted and retained in the housing positively even when the connector is assembled without considering a backward motion caused by the elasticity of the waterproof plug. Consequently, the connector assembling work efficiency is improved and it is possible to realize a highly reliable connector which scarcely breaks down.

What is claimed is:

1. A packing plug assembly for use in a connector housing to provide a seal therewithin comprising:

a resilient plug body having a first end and a second end, said resilient plug body having main hole means formed therein to open at said first and second ends to accept an insulated electric wire therethrough, and auxiliary hole means formed therein opening at said first and second ends; and rigid reinforcing means inserted into said auxiliary hole means and projecting from the first and second ends to provide a rigidity at said first and second ends of said resilient plug.

2. A packing plug assembly according to claim 1, wherein said auxiliary hole means a pair of through holes, said rigid reinforcing means including a pair of elongated members received in said through holes.

3. A waterproof connector comprising:

a connector housing adapted to receive mating terminals therein for connection with each other and having latch means for retaining said terminals therein;

a resilient plug body having a first end and a second end, said resilient plug body having main hole means formed therein to open at said first and second ends to accept an insulated electric wire therethrough, and auxiliary hole means formed therein and opening at said first and second ends, said electric wire being crimped by said terminals at a leading end of said electric wire;

rigid reinforcing means inserted into said auxiliary hole means and projecting from the first and second ends to provide a rigidity at said first and second ends of said resilient plug; and means for said rigid reinforcing means to press in turn said terminals into engagement with said latch means.

4. A waterproof connector according to claim 3, wherein said auxiliary hole means having a pair of through holes, said rigid reinforcing means including a pair of elongated members received in said through holes.

* * * * *